United States Patent [19]

Lillelund et al.

[11] Patent Number: 4,923,085

[45] Date of Patent: May 8, 1990

[54] CONTAINER WITH PRESSURE-RELEASE LID

[75] Inventors: Stig Lillelund; Eskil H. Olsen, both of Gentofte, Denmark

[73] Assignee: Dart Industries Inc., Deerfield, Ill.

[21] Appl. No.: 269,502

[22] Filed: Nov. 14, 1988

[51] Int. Cl.[5] ..... B65D 43/04

[52] U.S. Cl. ..... 220/282

[58] Field of Search ..... 215/296, 301; 220/282, 220/283

[56] References Cited

U.S. PATENT DOCUMENTS

| | | | |
|---|---|---|---|
| 1,141,534 | 6/1915 | Ford . | |
| 2,307,028 | 1/1943 | Dahlgren . | |
| 2,327,406 | 8/1943 | Dukehart, Jr. . | |
| 2,347,724 | 5/1944 | White | 220/281 |
| 2,351,783 | 6/1944 | Punte . | |
| 2,491,264 | 12/1949 | Hermani . | |
| 2,579,954 | 12/1951 | O'Neil | 220/283 |
| 2,906,428 | 9/1959 | Fralick . | |
| 3,131,410 | 5/1964 | Anderson | 220/281 X |
| 3,995,766 | 12/1976 | Fralick | 220/282 |
| 4,133,449 | 1/1979 | Ostrowsky | 220/283 X |
| 4,807,778 | 2/1989 | Lo | 220/282 |

FOREIGN PATENT DOCUMENTS

| | | | |
|---|---|---|---|
| 57270 | 10/1952 | France | 220/282 |

*Primary Examiner*—Donald F. Norton

*Attorney, Agent, or Firm*—John A. Doninger

[57] ABSTRACT

A container lid engageable with the planar outer edge of a container mouth in overlying sealing relation to the mouth. The lid includes a depending peripheral sealing flange engaged with the container adjacent the mouth, and a top panel with a base surface having a pair of spaced fulcrums seated on the mouth edge. The top panel is divided by the fulcrums into a first major portion and a second minor portion. When the lid seals the container the under or base surface of the major portion parallels the mouth edge with the flange engaged with the container wall completely about the mouth. The minor portion of the top panel of the lid includes an under or base surface upwardly angled or offset from the mouth edge in the sealed position of the lid whereby pressure on the minor portion pivots the lid about the fulcrums and upwardly releases the major portion of the lid and corresponding portion of the flange from the container mouth.

10 Claims, 3 Drawing Sheets

CONTAINER WITH PRESSURE-RELEASE LID

BACKGROUND OF THE INVENTION

Lids or closures, in a variety of forms, are commonly removably associated with container mouths for allowing selective access to the interior of the container for the introduction or removal of container contents. The closures will normally seal the containers when mounted with the degree of seal depending upon the container contents and the particular construction of the closure.

Conventional closures assume a wide variety of shapes, for example caps, plugs, hinged flaps, and the like. Similarly, a wide variety of means is provided for securing the closure, including mating threads, frictionally engaging surfaces, detents, and the like.

The securing means of each closure is normally a function of the specific type of closure and the desired relationship thereof to the container. For example, the container may be specifically configured whereby the opening is surrounded by a peripheral wall either internally or externally threaded. Such a mouth may comprise the entire upper end of a container or a pouring neck projecting from the closed end of a container. In each case, the closure will include mating threads, either internally or externally in accord with the threaded container mouth. Such closures must, of necessity, include appreciable externally accessible portions to allow for a manual gripping and rotational manipulation of the closure. It will also be appreciated that the container itself need be specifically formed with threads or the like.

Other forms of closures, for example snap-on lids, similarly require the provision of specific means on the container for retention of the lid, as well as means on the lid enabling a positive manual grasping thereof.

One form of closure which can frequently be accommodated in a container opening or mouth without elaborate container modification is a simple plug which is merely frictionally received within the opening. However, provision must also be provided for removal of the plug, either by retaining a specific portion of the plug exposed for manual grasping, or utilizing a specific extraction tool, such as for example a corkscrew for a wine bottle cork.

Another form of closure, normally found on small pill boxes, dispensers, and the like, utilizes a lid which when depressed will pivot about a fulcrum point or points defined on the container itself, the container normally being specifically configured, for example recessed, to accommodate pivotal movement of the lid. A related form of closure utilizes a depending skirt which completely encircles the container wall about the mouth and includes means thereon for engaging a portion of the container wall for a pivotal cooperation therewith. Note for example the following two patents:

| | | |
|---|---|---|
| 2,327,406 | Dukehart, Jr. | August 24, 1943 |
| 2,351,783 | Punte | June 20, 1944 |

In each of the described instances, the basic shape of the lid is generally dictated by the nature of the sealing and/or opening relationship to the container. For example pivoting lids normally require depending external skirts, screw or plug type closures necessitate provision for manual grasping, lids with limited access require special opening procedures or means.

SUMMARY OF THE INVENTION

The present invention proposes a unique lid construction which basically comprises a top or top panel adapted to overlie and close a container mouth, whether this be the whole upper end of a container or a relatively smaller container spout. In either case, the container mouth presents a planar upper or outer edge surface and requires no unique structural configuration to accommodate the lid, notwithstanding the unique capability of the lid to alternatively positively seal the container and pop upwardly to a released position therefrom.

The actual sealing of the container is effected by a sealing flange peripherally about the lid depending from the under or base surface of the top panel and engaging about the wall of the container immediately below the open mouth. The engagement of the flange with the container wall is such as to provide the desired seal in accord with the requirements of the contents of the container. The seal is also to be such as to provide for a firm securement of the lid against any possibility of accidental release. As desired, appropriate frictionally interengaging sealing lips can be provided about the mating surfaces of the lid flange and the container wall.

The top panel member of the lid includes a peripheral portion which is coextensive with and directly overlies the mouth edge upon an engagement of the sealing flange with the container wall. The base surface of the top member includes a pair of opposed fulcrums which engage the mouth edge and allow for a rocking of the lid between a sealed and a released position. In the sealed position, the sealing flange is peripherally engaged and sealed about the container mouth and the major extent of the lid top panel stably seated on the mouth edge. A minor portion of the top panel, to the opposite side of the transverse plane of the fulcrums, is upwardly of the mouth edge and not directly supported thereon. In this manner, the unsupported portion of the lid panel, upon depression thereof toward the container mouth, will rock the lid about the fulcrums and upwardly pop or release the opposed portion of the lid, and more particularly the seal, for unencumbered grasping and removal of the lid.

Such an arrangement is particularly desirable in that the upper portion of the lid can be of any configuration, from a decorative projecting top to a planar or substantially planar disc of minimal thickness.

A lid of minimal thickness is particularly desirable in minimizing the height of the overall container. In addition, with an internal sealing flange in the nature of a plug, the lid, while removable, can appear almost as an integral portion of the container with the outer edge of the lid top panel coextensive with the outer periphery of the container.

While such a lid, if of conventional construction, would not be particularly desirable in light of the difficulties in providing for manipulation and removal, such a lid incorporating the features of the present invention can substantially instantaneously both mount on and be removed from a container. Basically, the user need merely depress one edge of the container lid panel with the lid pivoting about the fulcrum and in effect popping up into the user's hand. The pair of fulcrums can be defined by an angled base surface on the top panel including a major planar portion which seats over a major portion of the mouth edge in the sealed position of the lid, whereat the sealing flange peripherally engages about the container mouth, and a second minor planar base surface upwardly offset or angled from the major base surface to extend above the corresponding minor portion of the container mouth. In this raised section, it will be appreciated that the associated portion of the sealing flange is of a relatively greater height so as to maintain continuous sealed engagement with the container mouth. Upon a depression of the lid panel above the elevated section, the lid will pivot about the fulcrums and release the sealing flange coextensive with the major base section and simultaneously elevate that portion of the lid for easy grasping by the fingers of the user.

As an alternative to the angled planar base sections, the major base section can include, at the line of intersection between the major base section and the minor base section, a pair of depending rocking lugs which define the fulcrum points. In order to stabilize the major base section in the sealing position of the lid relative to the container mouth, a pair of support lugs can be provided depending from the lid top member at points peripherally spaced about the major section from the plane of the two fulcrums.

DESCRIPTION OF PREFERRED EMBODIMENTS

Figure 1:
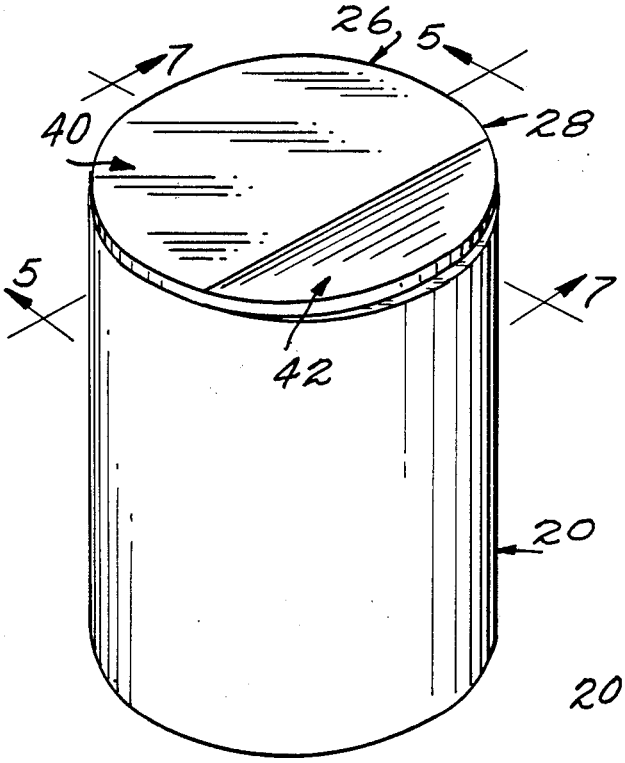
FIG. 1 is a top perspective view of a container with a rocking lid in accord with the present invention.
Figure 2:
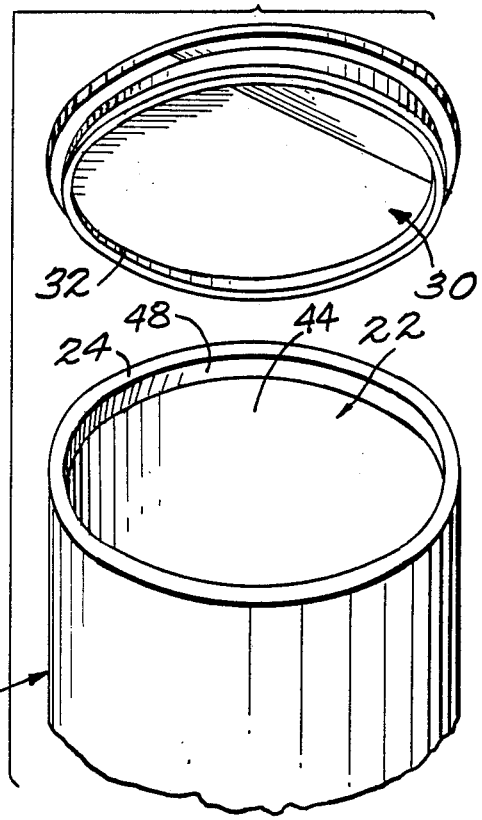
FIG. 2 is an exploded perspective view of the lid and upper portion of the container of FIG. 1.
Figure 3:
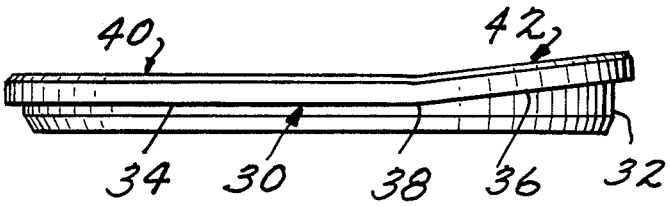
FIG. 3 is a side elevational view of the rocking lid.

Referring now more specifically to the drawings, and in particular FIGS. 1–10, the container 20 is a typical container which, while illustrated as cylindrical and vertically elongate, can be of other shapes which, in each instance, define an open container mouth 22 having a peripheral planar mouth edge 24.

The lid 26 includes a top panel or member 28 having an under or base surface 30, and a depending, normally integrally molded, sealing flange 32.

The base surface 30 comprises a first larger planar base surface section 34 and a second relatively smaller planar base surface section 36 extending upwardly from the base surface section 34 at an acute angle to the horizontal and from a transverse line defining a pair of opposed fulcrums or fulcrum points 38 at those opposed portions of the base surface which seat on the mouth edge 24. As illustrated, these fulcrums 38 are defined on a peripheral or lip portion of the top member 28 about and immediately outward of the sealing flange 32. So arranged, the sealing flange 32 engages, in the manner of a plug, within the container mouth 22 while the peripheral or lip portion of the top member 28 seats on the mouth edge 24. Noting the detail of FIG. 10, the peripheral or lip portion, which overlies and seats on the mouth edge 24, may be slightly thicker than the remainder of the top panel. This, as an example, can add a degree of rigidity to the lid in those instances wherein only very minimal thickness is required to close the mouth 22 itself.

The relationship of the sealing flange 32 to the base surface 30 is such whereby the sealing flange 32 peripherally seals on the sealing surface 48 within the container mouth 22 when the common support plane of the first base surface section 34, or more particularly the peripheral or lip portion thereof, is fully seated on the mouth edge 24. As such, it will be appreciated that the relative height of the sealing flange 32 increases as the upper or angled level of the second base surface section 36 diverges. This relationship will be readily apparent in FIGS. 3, 6 and 7. When so positioned on the container, the rocking lid of the invention is stably supported and effectively seals the container peripherally thereabout. The opposed fulcrums 38 seat directly on the container mouth edge and define the division between the multiple levels of the bottom or base surface.

In the lid 26 illustrated, it will be noted that the top member 28 is extremely thin, peripherally coextensive with the outer surface of the container wall to define a smooth continuation thereof, and is defined by a pair of substantially planar panels 40 and 42 which includes respectively the base surface sections 34 and 36. The lid, so formed, provides substantially no disruption of the container surface appearance, and is compact, adding little extraneous bulk to the container. However, normally a lid so formed presents difficulties when the lid is to be removed. Such difficulties are obviated in the present situation in that in order to open the rocking lid 26, one need merely press down on the elevated portion of the lid to effect a rocking of the lid about the opposed fulcrum points 38 and an upward popping of the opposed portion of the lid from the point of application of the pressure. Such an opening is suggested in and will be apparent from FIGS. 8 and 9. As a practical matter, one need merely press the heel of one's hand on the elevated portion with the resultant pivoting of the lid actually popping the lid up into the user's hand for removal in one smooth motion. There is no necessity for twisting, pulling or otherwise awkwardly manipulating the lid.

Figure 10:
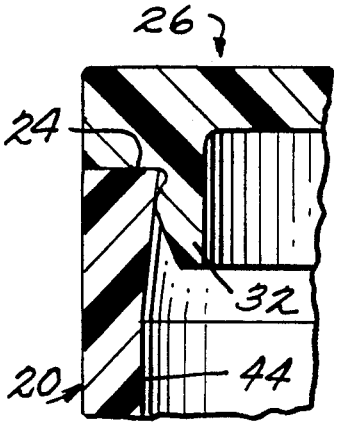
FIG. 10 is an enlarged detail of a seated edge portion of the lid.

As noted in the various cross-sectional views, and the enlarged cross-sectional detail of FIG. 10, the mating surfaces of the sealing flange 32 and the container surface 44 inward of the mouth edge 24 may have frictionally engaging projections or lip-like portions to enhance the seal.

Figure 11:
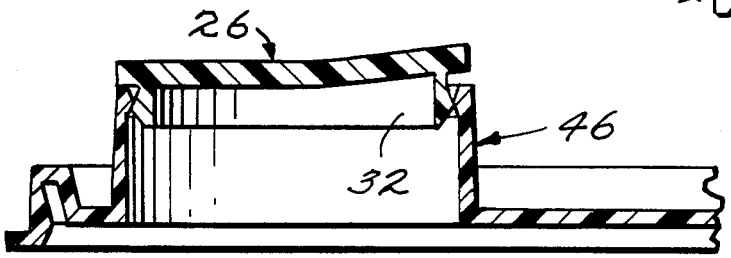
FIG. 11 is a cross-sectional detail illustrating a variation wherein the rocking lid mounts within a nozzle wherein the peripheral wall of the nozzle is equated to the container wall.
Figure 4:
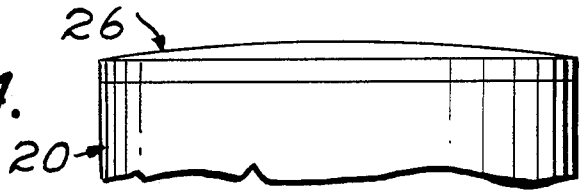
FIG. 4 is a side elevational view of the upper portion of the container and lid of FIG. 1.
Figure 5:
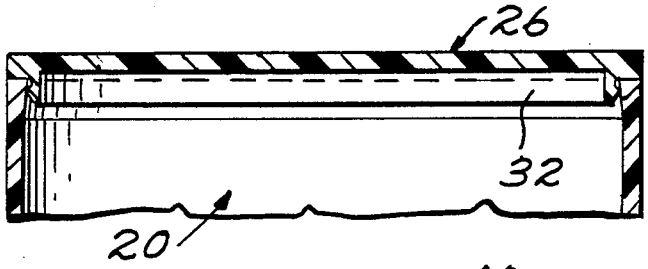
FIG. 5 is an enlarged cross-sectional detail taken substantially on a plane passing along line 5—5 in FIG. 1.
Figure 6:
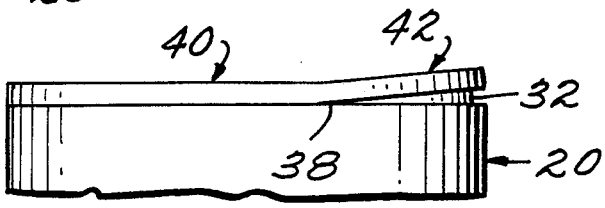
FIG. 6 is a side elevational view of the upper portion of the container, at 90° to FIG. 4, with the rocking lid in sealed position thereon.
Figure 7:
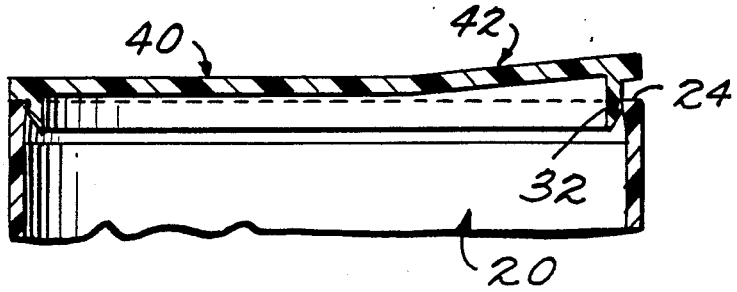
FIG. 7 is an enlarged cross-sectional detail taken substantially on a plane passing along line 7—7 in FIG. 1, and corresponding to the elevational view of FIG. 6.
Figure 8:
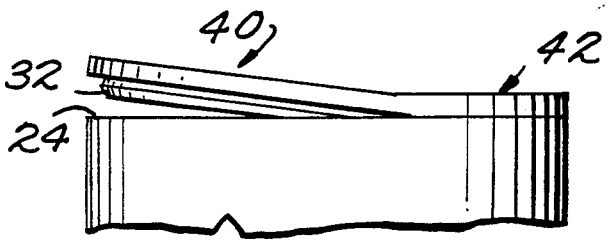
FIG. 8 is an elevational view of the upper portion of the container, oriented similar to FIG. 6 and with the lid rocked to the release position.
Figure 9:
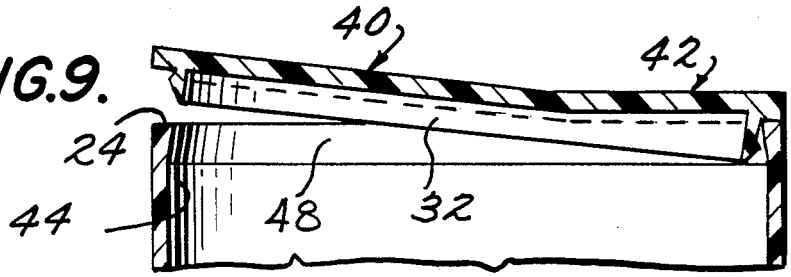
FIG. 9 is an enlarged cross-sectional detail of the container with released lid.
Figure 12:
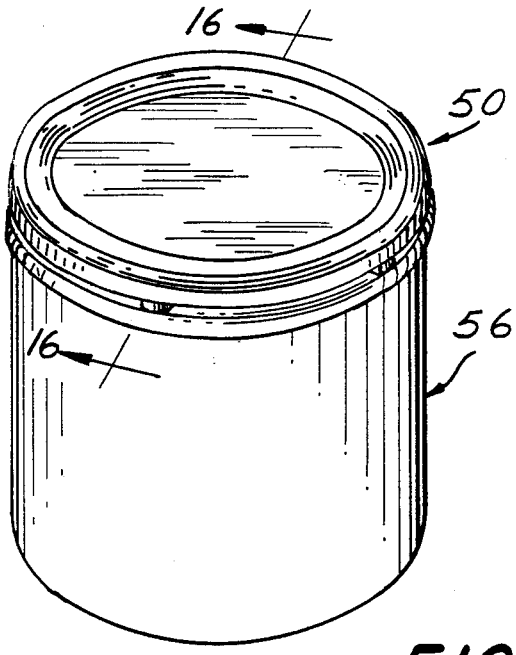
FIG. 12 is a top perspective view of a container with a variation of the rocking lid.
Figure 13:
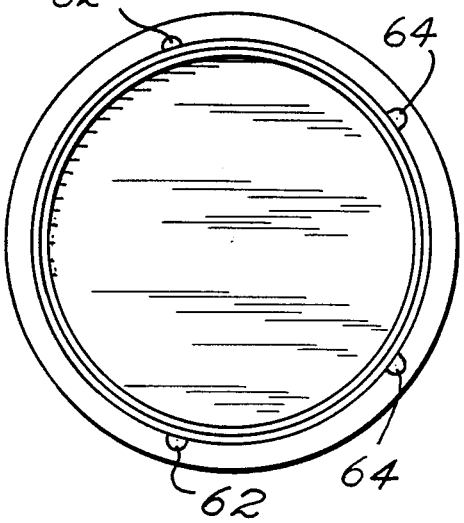
FIG. 13 is a bottom plan view of the lid of FIG. 12.
Figure 14:
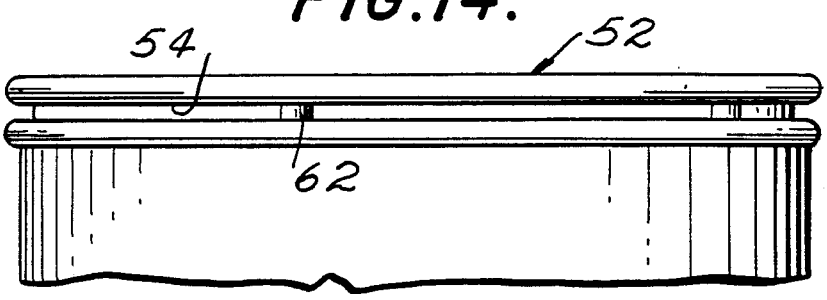
FIG. 14 is an elevational view of the upper portion of the container of FIG. 12 with the rocking lid in a container-sealing position.

FIG. 11 is a cross-sectional detail illustrating the feasibility of using a rocking lid 26 as a closure for a container spout or nozzle 46. The relationship of the rocking lid 26 to the mouth of the spout 46 will be as above described with regard to the container mouth 22 defined by the container wall itself. As such, the wall of the spout 46, for purposes of the claims following hereinafter, is considered a container wall.

Referring now to FIGS. 12–16, the lid 50 illustrated therein is a variation of the initially described lid 26. The lid 50 includes a top panel member 52 with a planar base surface 54 which is coextensive with the open or mouth end of the container 56 and peripherally overlies the container mouth edge 58. As illustrated, the top member 52 is a substantially planar member in its entirety with the unique release system of the present invention eliminating any necessity to so configure the exterior of the top member as to enable a lid-releasing grasping, rotation or pulling thereon as in conventional container lids.

The sealing of the lid 50 to the container 56 is effected by a peripheral depending sealing flange 60 which engages peripherally against the container wall adjacent the mouth edge 58. The height of the flange 60 is constant and sufficient to effectively seal with the container wall, for example in the manner of a plug closure.

The lid 50, at opposed points on the undersurface of the top member 52 and in the lip area immediately outward of the sealing flange 60 is provided with a pair of rocking lugs 62. The lugs 62 are integral with the under or base surface 54 of the top member 52 and are on a line which divides the top member into a first major portion and a second minor portion. The major portion, defined to the right of a chord line connecting the rocking lugs 62 in FIG. 13, includes a second pair of lugs 64 integral with the base or undersurface 54 of the top member 52 and of equal height with the rocking lugs 62. The lugs 64 define positioning lugs which, in cooperation with the rocking lugs 62, form a common support plane and support the lid 50 in its closed sealing position on the container 56 with the sealing flange 60 engaged within the container mouth in the manner of a plug. It will be appreciated that the top member 52 of the lid 50, in this embodiment, will actually be positioned above the mouth edge 58 a height equal to the height of the rocking and positioning lugs 62 and 64.

Figure 15:
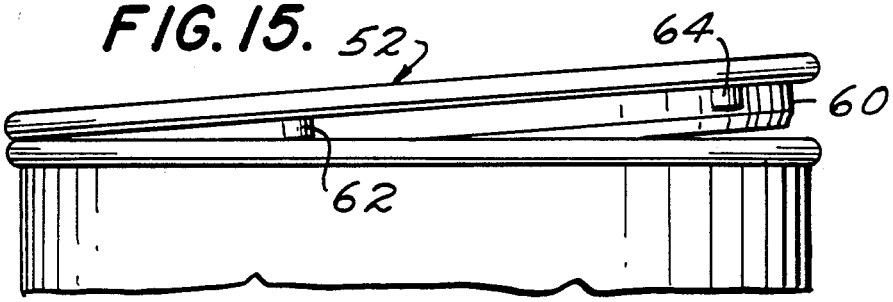
FIG. 15 is a similar elevational view with the rocking lid released.

Release of the lid 50 for removal is easily effected, without regard for the thickness of the top member 52 or the provision of easily graspable portions thereon, by a rocking of the lid about the rocking lugs 62. This is easily effected by downward pressure on the section of the lid constituting a minor portion or arc thereof, that portion to the left of a chord line extending between the rocking lugs 62 in FIG. 13. The rocking release of the lid is illustrated in FIG. 15 with the upwardly sprung portion of the lid to the right in FIG. 15 being readily accessible to the fingers which in turn can readily engage beneath the now free and upwardly pivoted edge portion.

Figure 16:
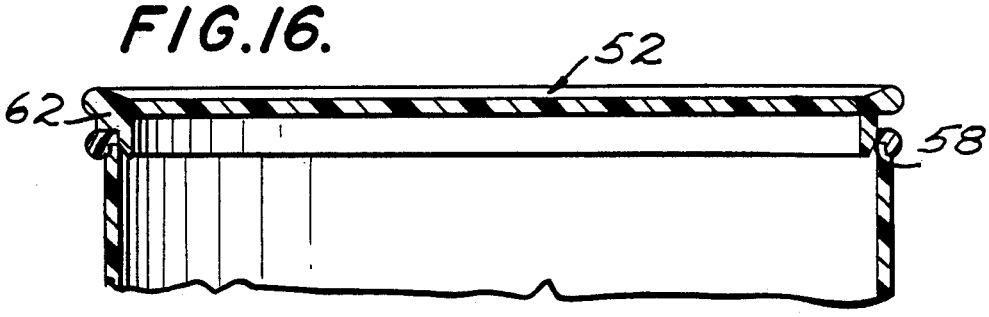
FIG. 16 is a cross-sectional detail taken substantially on a plane passing along line 16—16 in FIG. 12.

As noted in FIG. 16, the mouth edge 58 of the container 56 can be defined by a separate annular collar fixed thereto for decorative purposes, to stabilize the container mouth, or any of a variety of other reasons. A conforming configuration may also be provided about the outer edge portion of the lid 50.

The foregoing is considered illustrative of the principles of the invention. Variations and modifications may occur to those skilled in the art. As such, it is not desired to limit the invention to the exact constructions shown and described.

We claim:

1. A rocking lid for a container mouth, said lid including a top member having an underlying base surface with a depending peripheral flange, said base surface comprising first and second planar surface sections, said second surface section extending from said first section at an upwardly inclined angle and defining a fulcrum line between said sections, said flange being of a constant height below said first surface section and of an increasing height below said second surface section and outward of said first surface section.

2. The rocking lid of claim 1 wherein said top member projects radially outward of said flange peripherally thereabout.

3. The rocking lid of claim 2 wherein said top member includes a lip portion radially outward of said flange, said lip portion includes an undersurface said undersurface defining said base surface.

4. A container and a rocking lid for use in conjunction with said container, said container having an open mouth defined by a peripheral planar edge and a peripheral wall depending from said planar edge, said peripheral wall including a sealing surface thereabout, said rocking lid comprising a top member adapted to overlie and cover the container mouth said top member including a downwardly facing base surface and a peripheral sealing flange depending from said base surface for engagement with the sealing surface of the container wall, said base surface defining a first plane coextensive with and positionable in overlying engagenment with a portion of the peripheral planar edge and a second plane upwardly angled related to firs plane, fulcrum means between said planes engageable against the peripheral planar edge for rocking of said lid to engage said second plane with the peripheral planar edge and position said first plane in upwardly angled relation thereto, said peripheral sealing flange having a lower edge generally parallel to said first plane.

5. The container and rocking lid of claim 8 wherein said top member includes a lip portion extending radially outward of said sealing flange and peripherally thereabout, said lip portion having planar undersurfaces defining said first and second planes.

6. A removable closure for a container having an open container mouth defined by a mouth edge, said removable closure comprising: a rocking lid mountable on said container for movement between an open position and a closed position relative to the container mouth, said lid having a top member for overlying the container mouth, said top member including a base surface and a sealing flange depending from said base surface for engagement with the container, fulcrum means on said base surface engageable with the mouth edge and dividing said base surface into a first section and a second section, said first section being engageable with the mouth edge simultaneous with said fulcrum means and defining a common support plane with said fulcrum means to parallel the mouth edge in the closed position of the lid, said sealing flange depending below said common support plane for engagement with the container in the closed position of the lid, said second section being upwardly offset from the common support plane of the first section for positioning above the container mouth whereby pivoted movement of said second section downward about said fulcrum means toward the mouth edge will effect a pivotal upward movement of said first section away from the mouth edge.

7. The removable closure of claim 6 wherein said rocking lid second base surface section extends from said first base surface section at an acute angle relative to said common support plane.

8. The removable closure of claim 7 wherein said rocking lid fulcrum means is defined by the intersection of said first base surface section and said second base surface section.

9. The removable closure of claim 8 wherein said rocking lid top member includes a lip portion, said lip portion extends radially outward of said sealing flange and peripherally thereabout.

10. The removable closure of claim 9 wherein said top member lip portion includes an undersurface, said undersurface defining said base surface.

* * * * *